US005684495A

United States Patent [19]

Dyott et al.

[11] Patent Number: 5,684,495

[45] Date of Patent: Nov. 4, 1997

[54] MICROWAVE TRANSITION USING DIELECTRIC WAVEGUIDES

[75] Inventors: Richard B. Dyott, Oak Lawn; Thomas D. Monte, Lockport, both of Ill.

[73] Assignee: Andrew Corporation, Orland Park, Ill.

[21] Appl. No.: 521,269

[22] Filed: Aug. 30, 1995

[51] Int. Cl.[6] ..... H01Q 13/02

[52] U.S. Cl. ..... 343/785; 333/21 R; 333/248; 333/251

[58] Field of Search ..... 333/21 R, 239, 333/240, 248, 284, 251; 343/785, 786

[56] References Cited

U.S. PATENT DOCUMENTS

| | | | |
|---|---|---|---|
| 3,216,017 | 11/1965 | Moore | 333/21 R X |
| 4,274,097 | 6/1981 | Krall et al. | 343/719 |
| 4,307,938 | 12/1981 | Dyott | 385/123 |
| 4,482,899 | 11/1984 | Dragone | 343/786 |
| 4,630,316 | 12/1986 | Vaughan | 333/251 X |
| 4,673,947 | 6/1987 | Newham | 343/785 X |
| 5,017,937 | 5/1991 | Newham et al. | 343/785 |

FOREIGN PATENT DOCUMENTS

| | | | |
|---|---|---|---|
| 1201199 | 2/1986 | Canada . | |
| 9350 | 1/1977 | Japan | 343/785 |
| 1525780 | 11/1989 | U.S.S.R. . | |
| 2208757 | 4/1989 | United Kingdom . | |

OTHER PUBLICATIONS

Kobayashi et al. "Dielectric Tapered Rod Antennas for Millimeter-Wave Applications", IEEE Transactions on Antennas and Propagation, vol. AP-30, No. 1, pp. 54–58, Jan. 1982.

Buckingham et al. "Low-loss Polypropylene for Electrical Purposes", PROC.IEE, vol. 114, No. 11, pp. 1810–1814, Nov. 1967.

*Primary Examiner*—Paul Gensler
*Attorney, Agent, or Firm*—Arnold, White & Durkee

[57] ABSTRACT

A microwave antenna comprises a single moded metal waveguide tapering inwardly to a cutoff dimension near the distal end thereof. The antenna also comprises a first solid dielectric waveguide mounted coaxially within the distal end portion of the metal waveguide and tapering outwardly toward the inwardly tapering portion of the metal waveguide. The first dielectric waveguide extends beyond the distal end of the metal waveguide in the axial direction. The antenna also comprises a second dielectric waveguide surrounding the first dielectric waveguide beyond the distal end of the metal waveguide and having a dielectric constant lower than the dielectric constant of the first dielectric waveguide. A distal end portion of the first dielectric waveguide tapers inwardly toward the axis thereof, to launch signals propagating toward the distal end of the first dielectric waveguide into the second dielectric waveguide.

72 Claims, 5 Drawing Sheets

MICROWAVE TRANSITION USING DIELECTRIC WAVEGUIDES

FIELD OF THE INVENTION

The present invention relates generally to microwave transitions and antennas of the type that utilize dielectric rods.

SUMMARY OF THE INVENTION

It is a principal object of the present invention to provide an improved microwave transition for efficiently launching microwave signals from a metallic waveguide into a dielectric waveguide.

It is another primary object of the present invention to provide an improved dielectric rod antenna that is capable of producing gains in excess of 20 dB when operated at frequencies of 10 GHz and higher.

Another important object of this invention is to provide an improved dielectric rod antenna which produces a pattern having a narrow main lobe and very small side lobes in both the E and H planes.

A further object of this invention is to provide an improved dielectric rod antenna which is both small and light weight.

Still another object of this invention is to provide such improved microwave transitions and dielectric rod antennas which can be efficiently and economically manufactured.

Other objects and advantages of the invention will be apparent from the following detailed description and the accompanying drawings.

In accordance with the present invention, the foregoing objectives are realized by providing a microwave transition comprising a single-moded metal waveguide, a dielectric rod mounted coaxially within the distal end portion of the metal waveguide and made of a first dielectric material, a distal portion of the dielectric rod extending beyond the distal end of the metal waveguide, and a second dielectric material surrounding the dielectric rod beyond the distal end of the metal waveguide and having a dielectric constant lower than the dielectric constant of the first dielectric material. An end portion of the dielectric rod tapers inwardly toward the distal end thereof, to launch signals propagating toward the distal end of the dielectric rod into the second dielectric material.

The microwave transition of this invention is particularly useful to form a microwave antenna by terminating the second dielectric material at or beyond the distal end of the first dielectric material to radiate the signals launched into the second dielectric material from the dielectric rod, or to receive signals and couple them into the dielectric rod, and then on into the metal waveguide.

DETAILED DESCRIPTION OF THE PREFERRED EMBODIMENTS

While the invention will be described in connection with certain preferred embodiments, it will be understood that it is not intended to limit the invention to those particular embodiments. On the contrary, it is intended to cover all alternatives, modification and equivalents as may be included within the spirit and scope of the invention as defined by the appended claims.

Figure 1:
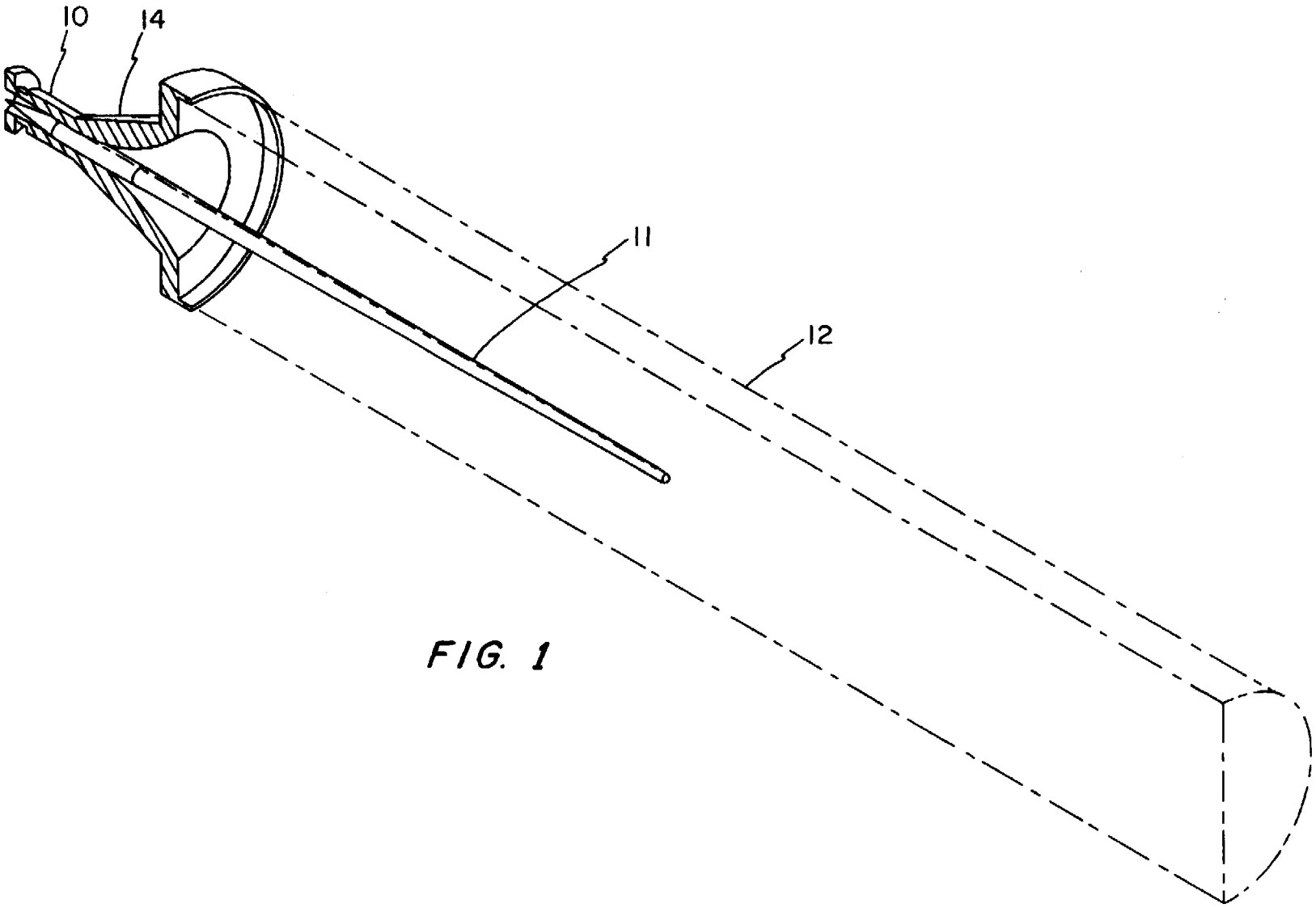
FIG. 1 is an exploded perspective view of a dielectric rod antenna embodying the present invention.
Figure 2:
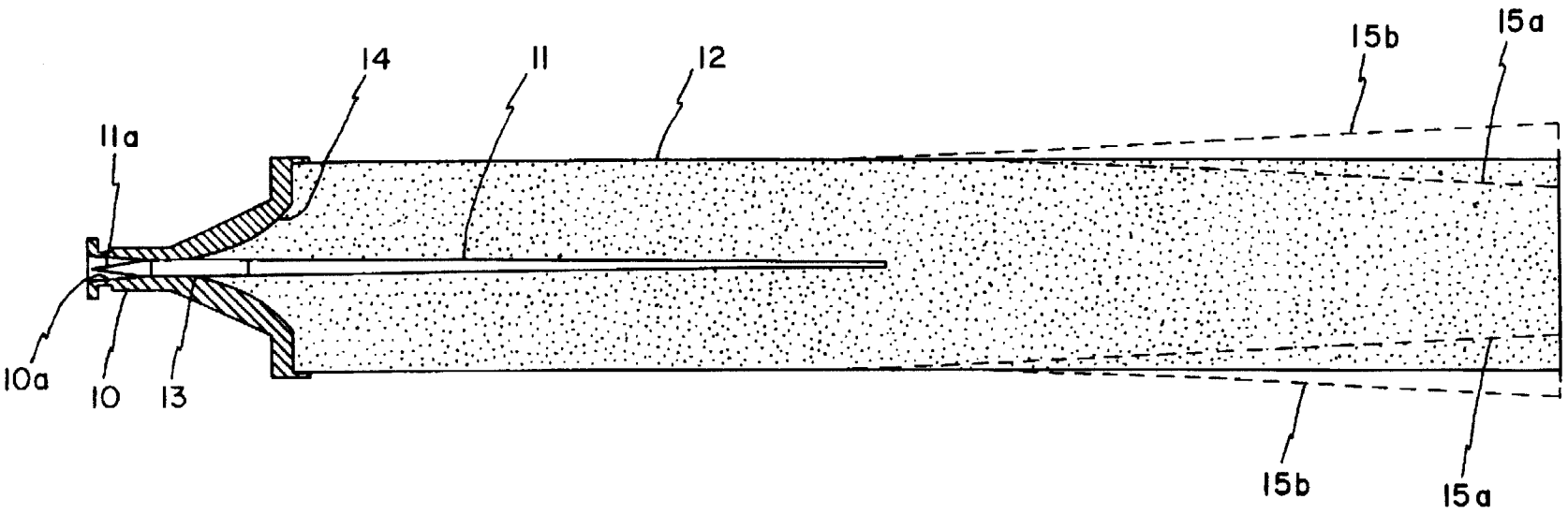
FIG. 2 is an enlarged longitudinal section of the dielectric rod antenna illustrated in FIG. 1.

Turning now to the drawings and referring first to FIGS. 1 and 2, there is shown a microwave antenna formed from three components, a metal waveguide 10 including a flared horn 14 on one end, a first dielectric waveguide 11, and a second dielectric waveguide 12. In the transmitting mode, the metal waveguide 10 receives microwave signals from a signal generating source connected to the proximal end of the waveguide, which is the left-hand end as viewed in FIGS. 1 and 2. The metal waveguide 10 preferably has a circular cross section, and is dimensioned so that the fundamental mode of signal propagation is the $TE_{11}$ mode, also known as the $H_{11}$ mode. The metal waveguide 10 is also preferably dimensioned so that it is single-moded, i.e., modes of higher order than the $TE_{11}$ mode are cut off.

The distal end portion of the metal waveguide 10 contains the first dielectric waveguide 11, which is in the form of a solid dielectric rod. The dielectric rod 11 preferably has a dielectric constant of less than about 4. One particularly suitable material is Rexolite having an dielectric constant $\epsilon$ of about 2.6. The proximal end portion 11*a* of the dielectric rod 11 tapers outwardly, and the surrounding portion 10*a* of the metal waveguide 10 tapers inwardly so as to transfer $TE_{11}$-mode signals to the dielectric rod 11. The inward tapering of the metal waveguide 10 and the outward tapering of the dielectric rod 11 terminate at 13 where the two surfaces meet each other. The minimum diameter of the metal waveguide 10 at 13, where the inward taper is terminated, is preferably less than the cutoff dimension for the $TM_{01}$ mode of the dielectric-filled circular waveguide.

As an alternative to the transition shown in FIGS. 1 and 2 for coupling energy between the metal waveguide and the dielectric waveguide, a metal waveguide cavity may be coupled at one end to a conventional probe extending into the cavity, and at the other end to the dielectric rod 11. In this case the rod 11 would be terminated within the throat of the horn 14 (i.e., the tapered section at the left-hand end of the rod 11 would be eliminated), and the metal waveguide cavity would have the same transverse cross-sectional size and shape as the rod 11.

The distal end portion of the metal waveguide 10 flares outwardly to form the horn 14, for launching signals from the metal waveguide 10 into the first dielectric waveguide 11. The portion of the dielectric rod 11 that is within the horn 14, i.e., between 13 and the distal end of the metal waveguide 10, has a substantially constant diameter. The horn 14 preferably has an exponential taper to remove the metal boundary gradually and ensure that the $TE_{11}$-mode signals are launched into the dielectric rod 11 in the $HE_{11}$ mode without any significant radiation from the horn aperture, i.e., the horn aperture is non-radiating at the operating frequency in the absence of the dielectric rod. The horn 14 is terminated at a diameter that is sufficiently large to reduce the evanescent tail of the field of the dielectric waveguide to a level about 40 to 50 dB below the peak value. An exponential horn taper is preferred because the slope is zero at the beginning of the horn, and then changes only gradually at the smaller diameters where the slope is most critical. At the larger diameters the slope is not as critical, and it is at these diameters that the slope of the exponential taper changes most rapidly. A particularly preferred exponential horn taper follows the equation $r=\exp(ax^2)-r_0$.

Beyond the horn 14, the dielectric rod 11 tapers inwardly at an angle sufficiently small (less than about 5°, preferably less than about 2°) to avoid appreciable radiation from the side surfaces of the rod 11. For a more compact design, the taper of the rod 11 may begin inside the horn 14. As the diameter of the rod 11 diminishes, the field external to the rod expands and is captured by the second dielectric waveguide 12 to form a relatively large antenna aperture. As will be discussed in more detail below, the maximum diameter of the rod 11 is selected to be large enough, for the dielectric constant of the rod material and at the operating frequency, to contain the fields in the rod. The minimum diameter is selected to be small enough to cause most of the energy distribution to be outside the rod 11. The taper between the maximum and minimum diameters, along the length of the rod 11, preferably decreases in slope as the diameter decreases, to minimize radiation from the taper.

The physical size of a dielectric waveguide depends on the dielectric constant of the core and the cladding material. The normalized wavenumber, $V_{drwg}$, of a dielectric rod waveguide is known to be $$V_{drwg}=k_0b(\epsilon_1-\epsilon_2)^{1/2}$$

where $k_0=2\pi/\lambda_0$, $\lambda_0$ is the operating wavelength, and b is the radius of the core. The relative permittivities of the core and cladding material are $\epsilon_1$ and $\epsilon_2$, respectively. The single-mode operating region is $$0<V_{drwg}<2.405$$

However, when $V_{drwg}$ is too low, the waveguide fields extend very far into the cladding. As a minimum from a practical viewpoint, $V_{drwg}>1$. Preferably, $V_{drwg}\cong1.5$ so that the field is tightly bounded to the waveguide. When $V_{drwg}<1$, a substantial amount of the power is outside the core. Therefore, from practical considerations the single-mode operating range of the dielectric rod waveguide is limited to $$1<V_{drwg}<2.405$$

The single-mode operating range of circular waveguide with perfectly conducting walls is given by $$1,841<V_{cwg}<2.405$$

Here $V_{cwg}=k_0a(\epsilon_1)^{1/2}$ where a is the radius of the metal boundary. The transition from a circular waveguide filled with dielectric having a permittivity $\epsilon_1$ and operating in the single mode range with radius a, to a dielectric rod waveguide of radius b consisting of the same dielectric material but submerged in the second dielectric material with permittivity $\epsilon_2$, also operating in the single-mode regime, is described below.

Figure 3:
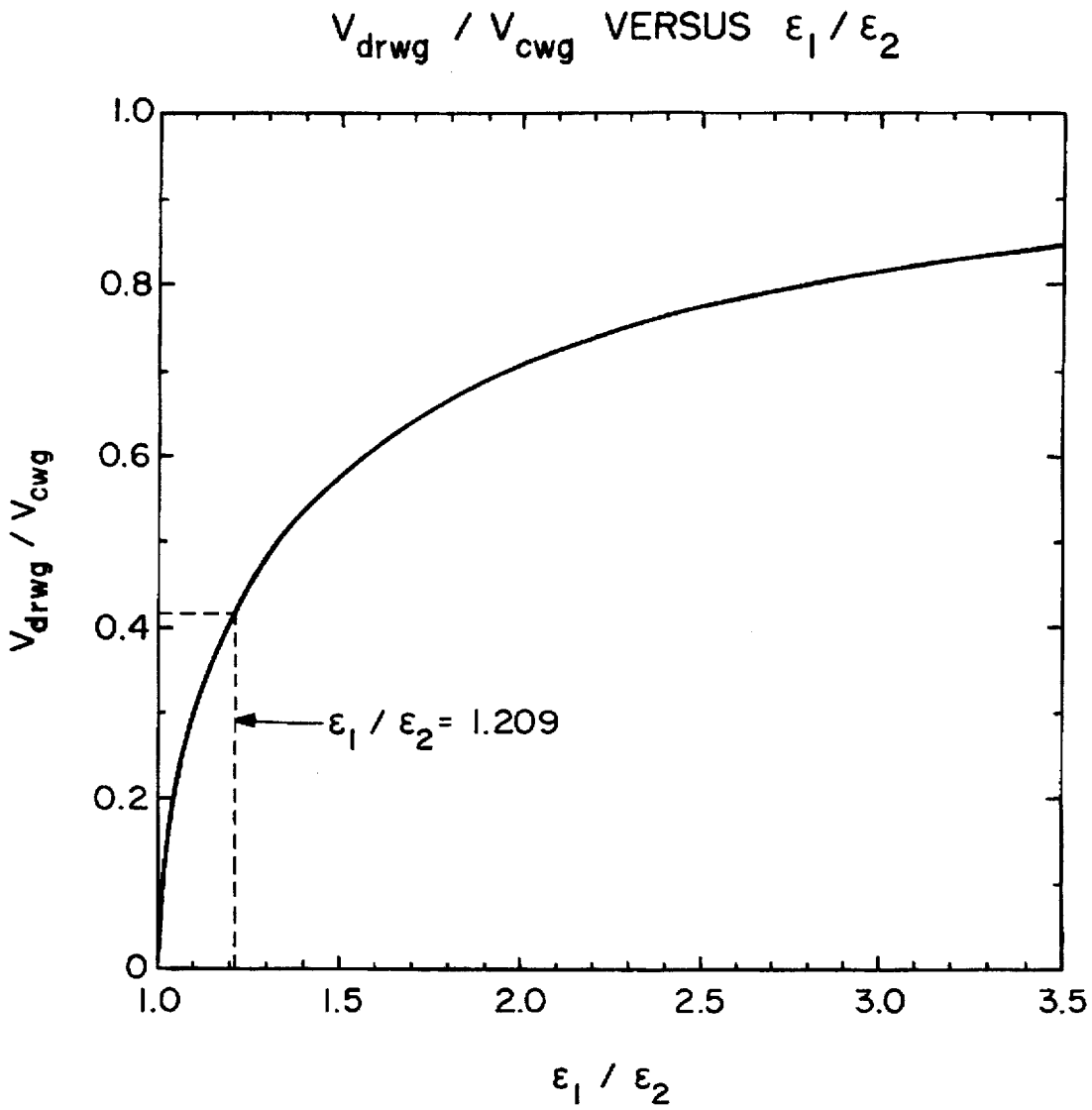
FIG. 3 is a graph of certain parameters relating dielectric rod waveguide to circular metallic dielectric filled waveguide.

The radius b of a dielectric rod waveguide depends on the ratio between $\epsilon_1$ and $\epsilon_2$. For large $\epsilon_1/\epsilon_2$, the radius is smaller than the radius of the circular waveguide. For small differences in the dielectric, the radius b becomes larger than the largest size allowed in the single-mode regime of the circular metallic waveguide. In this case, the transition from one waveguide to the other without higher-order mode generation is required. The ratio of the normalized wavenumbers is given by $$\frac{V_{drwg}}{V_{cwg}}=\left(\frac{\frac{\epsilon_1}{\epsilon_2}-1}{\frac{\epsilon_1}{\epsilon_2}}\right)^{1/2}$$

and is plotted in FIG. 3. There is a ratio of dielectric constants when the $V_{drwg}$ is at the minimum value and the $V_{cwg}$ is at the maximum value, which defines when $$\frac{\epsilon_1}{\epsilon_2}$$

is too small to provide a simple waveguide transition. This occurs at $$\frac{V_{drwg}}{V_{cwg}}=\frac{1}{2.405}=0.415.$$

By reversing the above equation, $$\frac{\epsilon_1}{\epsilon_2}=\frac{1}{1-\left(\frac{V_{drwg}}{V_{cwg}}\right)^2}$$

the critical ratio $\epsilon_1/\epsilon_2=1.209$ is found. For ratios below this critical value, the radius of the circular metallic waveguide is too large, and therefore overmoded. If the size of the rod is reduced to match the largest allowable size of the circular waveguide, then the operating $V_{drwg}$ is lower than an acceptable practical value. Returning to FIGS. 1 and 2, the proximal portion of the second dielectric waveguide 12 is formed around the dielectric rod 11, and the distal portion of the waveguide 12 preferably extends beyond the distal end of the rod 11. Alternatively, the dielectric waveguide 12 may terminate at the distal end of the rod 11. This second dielectric waveguide 12 is preferably formed of a foam dielectric so that it has a much smaller dielectric constant than the rod 11, and of course the waveguide 12 also has a larger diameter than the rod 11. The most preferred foam dielectrics are those having dielectric constants below about 4.0. The lower the dielectric constant of this waveguide 12, the larger the mode field distribution and, therefore, the larger the effective antenna aperture and the resultant gain.

The presence of the second dielectric waveguide 12 produces a substantial increase in the gain of the antenna, due to the larger mode field of the lower-dielectric-constant waveguide. The magnitude of the gain increase depends upon the diameter of the dielectric and the length of is extension beyond the distal end of the inner rod 11. As illustrated by the broken lines **15*a* and 15*b* in FIG. 2, the gain may be further increased by gradually tapering the second waveguide 12** to either increase or decrease its diameter toward the digital end, provided the taper is gradual enough to prevent radiation laterally from the second dielectric. The change in diameter effected by the taper changes the V of the dielectric waveguide, and the maximum gain can be increased by either increasing or decreasing V from a V value at which maximum gain is a minimum. Such tapers are particularly feasible for submillimeter waves because the size of the antenna is so small.

The antenna gain can also be increased by the use of multiple concentric sheaths of dielectric material, with each successive sheath having a lower dielectric constant than the adjacent inner sheath. Each sheath is tapered so that it reduces in diameter toward its distal end, and the next outer sheath extends axially beyond the end of its inwardly adjacent sheath. Each time an electromagnetic wave is handed off from one sheath to another, the mode field increases and thus the gain also increases.

The field distribution across the aperture of the antenna is approximately described in the rod by the Bessel $J_0$ function, which is periodic, and in the space surrounding the rod by the Bessel $K_0$ function, which decreases exponentially with increasing radius. The field distribution described by these functions becomes approximately gaussian when the aperture is sufficiently large, and thus the aperture radiates with a narrow main lobe and low side lobes. The radiation pattern also has rotational symmetry, and thus the first side lobe level is approximately the same in the E and H planes.

If desired, either or both of the dielectric waveguides 11 and 12 may be shaped for pattern or polarization control. For example, the inner waveguide 11 may be provided with a slightly elliptical transverse cross-section anywhere on the waveguide; if the induced total phase delay between both polarization senses, due to the geometry, is designed for 90 degrees, the antenna will receive or transmit circular polarization. Alternatively, the cross-sectional shape of the outer dielectric waveguide 12 may be shaped to improve the directivity of the radiation pattern; any resulting relative phase delay between the polarizations can be counteracted by providing a slight deformation in the inner waveguide 11 so that the antenna receives and transmits linearly polarized signals but radiates with a tailored pattern. Although the waveguides 11 and 12 have been illustrated as having circular transverse cross sections, other suitable transverse cross sections are elliptical, oval and rectangular.

The normalized wavenumber V in a solid dielectric waveguide is defined by the equation $$V=\frac{\pi d}{\lambda_0}(\epsilon_1-\epsilon_2)^{1/2}$$

where d is the diameter of the waveguide, $\lambda_0$ is the free space wavelength at the operating frequency, and $\epsilon_1$ and $\epsilon_2$ are the dielectric constants of the waveguide material and the material surrounding the waveguide, respectively.

For a circular rod, the value of V must be less than 2.4 to cut off modes of higher order than the desired $HE_{11}$ mode. In dielectric foam, $\epsilon_2$=1.03. Thus, for a Rexolite rod ($\epsilon_1$=2.55) surrounded by dielectric foam and operating at a frequency of 28.5 GHz, where $\lambda$=1.052 cm., the maximum value of the rod diameter d can be computed as follows:

$$\begin{aligned} 2.4 &= \frac{\pi d_{max}}{1.052}(2.55-1.03)^{1/2} \\ d_{max} &= \frac{(1.052\times 2.4)}{\pi(1.52)^{1/2}}=\frac{2.525}{3.873} \\ &= 0.652\text{ cm.} \end{aligned}$$

As a practical matter, the fields outside the rod extend too far when V is less than about 1.5. Thus, for a Rexolite rod in dielectric foam operating at 28.5 GHz, the minimum value of d can be computed as follows:

$$\begin{aligned} 1.5 &= \frac{\pi d_{min}}{1.052}(2.55-1.03)^{1/2} \\ d_{min} &= \frac{(1.052\times 1.5)}{\pi(1.52)^{1/2}}=\frac{1.578}{3.873} \\ &= 0.407\text{ cm.} \end{aligned}$$

In order to launch the $TE_{11}$-mode energy into the dielectric waveguide 11, the inside diameter of the metal waveguide 10 is reduced enough to cut off the $TM_{01}$ mode when the metal waveguide is filled with the Rexolite dielectric. To achieve this result, the inside diameter of the metal waveguide 10 must be reduced below 0.504 cm at 28.5 GHz. At this diameter, a dielectric material having a relatively high dielectric constant must be used to maintain the value of V above 1.5 and thereby avoid excessive expansion of the field outside the horn. After the signal is in the dielectric waveguide, however, the diameter of the waveguide can be gradually increased.

Figure 4:
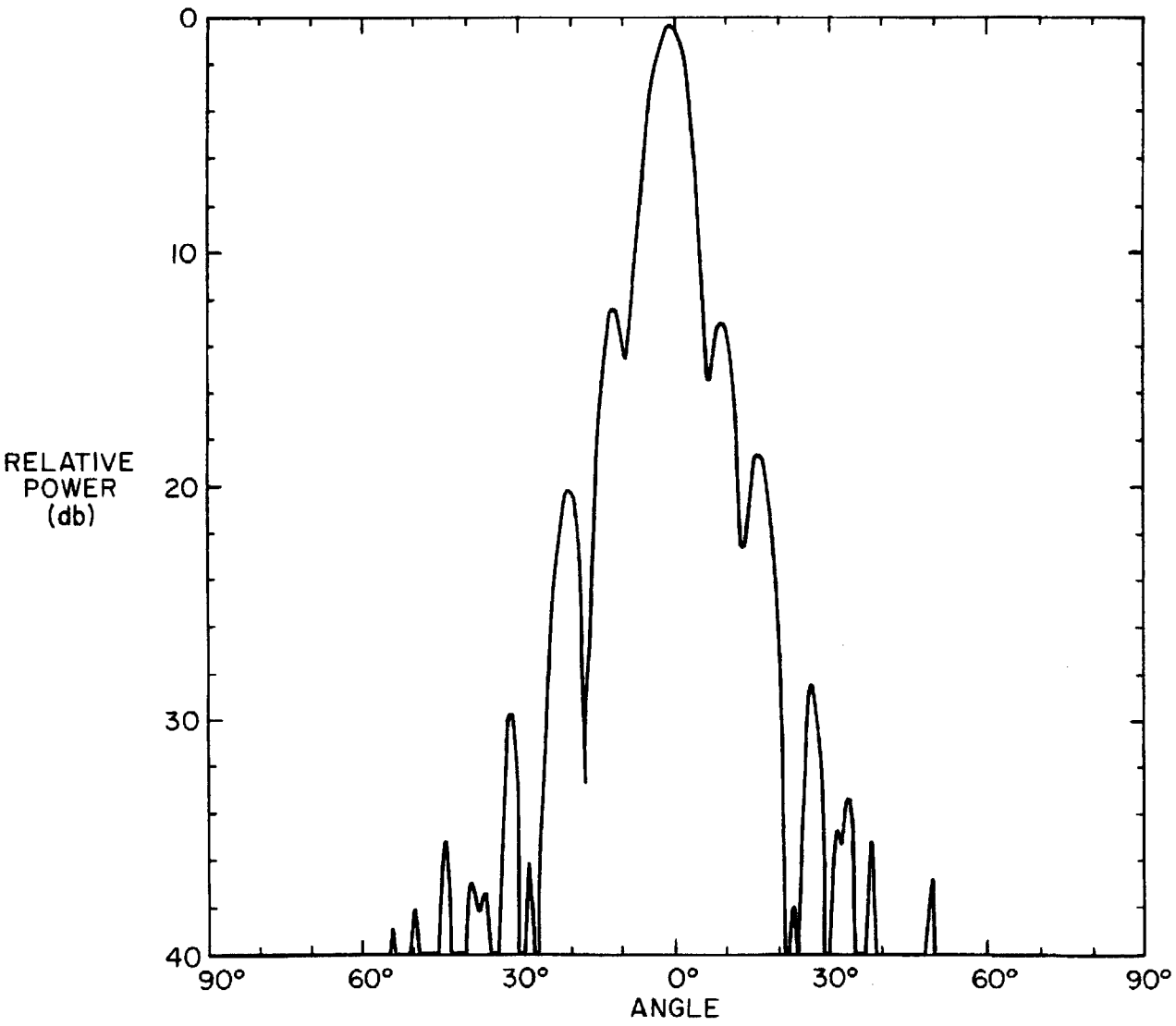
FIG. 4 is a radiation pattern produced by an exemplary antenna embodying the invention.

In one example of the invention, an antenna designed for operation at 28.5 GHz had an inner dielectric rod made of Rexolite with a diameter of 0.491 cm and a tapered section 19.3 cm in length and tapering down to a diameter of 0.246 cm. The outer dielectric sheath was made froth an expanded polystyrene foam and the sheath had a diameter of 3.81 cm and a length of 40.64 cm. The dielectric constants of the two dielectrics were 2.55 and 1.03. The V value of the Rexolite red with foam cladding waveguide before the tapered section was 1.8, and at the end of the tapered inner rod the V value was 0.9. The V value of the dielectric sheath with free space cladding waveguide was 2.12. This antenna produced good radiation patterns with a directivity of 25.4 dBi. An exemplary radiation pattern produced by this antenna is shown in FIG. 4 of the drawings.

The antenna of this invention is particularly useful in combination with a transmission line in the form of a dielectric waveguide, because signals can be coupled directly between the transmission line and the central inner rod of the antenna. Similarly, the antenna of this invention can be directly coupled to a high-frequency circuit formed from integrated-optics.

The transition used in the antenna of FIGS. 1 and 2 for converting the $TE_{11}$ mode to the $HE_{11}$ mode, and vice versa, is also useful in coupling a dielectric waveguide to a non-dielectric transmission line, such as a metal waveguide. In the transition illustrated in FIG. 5, microwave energy is coupled between a circular metal waveguide 30 and a circular dielectric waveguide 31. The metal waveguide 30 is standard circular waveguide. The dielectric waveguide 31 has a low density foam dielectric cladding 33. Also, the dielectric waveguide 31 has a core 32 made of either a solid dielectric or a foam dielectric slightly higher in density than the foam dielectric cladding 33. A solid dielectric rod 34 within the core 32 extends into the metal waveguide 30, in the same manner as the dielectric rod 11 described above. The rod 34 is gradually tapered toward its distal end before it terminates within the core 32. In the following example, the dielectric waveguide consists of a core of relatively higher density foam than the cladding. The dielectric constant of the cladding foam may be 1.035. The dielectric constant of the core may be 1.12. A dielectric waveguide of this type is desired due to the low loss properties of the foam dielectrics. The ratio of the two dielectric constants 1.082. This ratio is below the critical value of 1.209 and therefore the diameter of the core is larger than the diameter of a single-moded circular metallic waveguide.

Figure 5:
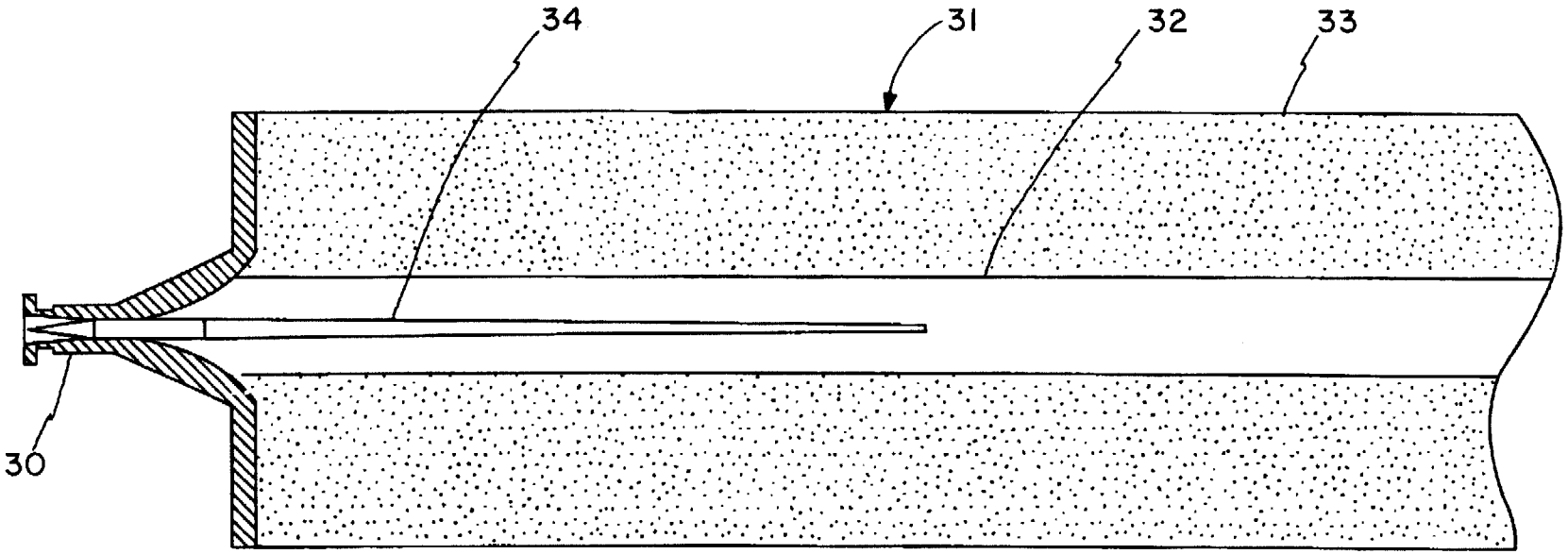
FIG. 5 is a longitudinal section of a microwave transition for launching microwave signals for a metallic waveguide into a dielectric waveguide.

There is preferably only a small difference between the dielectric constants of the adjoining dielectric materials used in the transition of FIG. 5. For example, the dielectric constants of the inner rod 34, the core 32, and the foam cladding 33 may be 2.55, 1.12 and 1.035, respectively. In a transition using materials having these dielectric constants and designed for operation at 38.5 GHz ($\lambda$=1.052 cm), the rod 34 may have a maximum diameter of 0.491 cm tapering down to 0.246 cm at its distal end along a length of 31.4 cm at a taper angle of 0.22°. The core 32 and the cladding 33 may have diameters of 2.296 and 11.483 cm, respectively.

The corresponding V values are 1.75 at the larger end of the tapered section of the rod 34, 0.87 at the small end of the tapered section of the rod 34, and 2.0 beyond the end of the rod 34. A particularly preferred dielectric material for the core 32 is isotactic polypropylene, which exhibits low loss characteristics at frequencies such as the 38.5 GHz mentioned above, and higher.

We claim:

1. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal end portion of said dielectric rod extending beyond the distal end of said metal waveguide, and a second dielectric material surrounding and extending beyond said dielectric rod beyond the distal end of said metal waveguide and having a dielectric constant $\epsilon_2$ lower than the dielectric constant of said first dielectric material, an end portion of said dielectric rod tapering inwardly toward the distal end thereof defining a dielectric transition region for launching signals propagating toward the distal end of said dielectric rod into said second dielectric material, said signals being single-moded throughout said dielectric transition region, said dielectric rod having a diameter $d_1$ at the beginning of said dielectric transition region and terminating within said second dielectric material defining an end of said dielectric transition region, said signals propagating beyond said dielectric rod and through said second dielectric material at the end of said dielectric transition region, said second dielectric material having a diameter $d_2$ at the end of said dielectric transition region, said first dielectric material having a wavenumber $V_1$ defined by the equation $\pi d_1(\pi_0)^{-1}(\epsilon_1-\epsilon_2)^{1/2}$, said second dielectric material having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

2. The microwave transition of claim 1 wherein the dielectric constant of said first dielectric material is less than about 4.

3. The microwave transition of claim 1 wherein said second dielectric material extends beyond the distal end of said dielectric rod.

4. The microwave transition of claim 1 wherein said metal waveguide containing said dielectric rod tapers inwardly to a cutoff dimension near the distal end thereof.

5. The microwave transition of claim 4 wherein said cutoff dimension of said metal waveguide containing said dielectric rod is less than the cutoff dimension for the $TM_{01}$ mode.

6. The microwave transition of claim 4 wherein said dielectric rod tapers outwardly toward the distal end of said metal waveguide, and the portion of said metal waveguide that is tapered inwardly is the portion that surrounds the outwardly tapered portion of said dielectric rod.

7. The microwave transition of claim 1 wherein the distal end of said metal waveguide is flared outwardly to launch signals from said metal waveguide into said dielectric rod.

8. The microwave antenna of claim 1 wherein said metal waveguide is circular waveguide dimensioned to propagate microwave signals in the $H_{11}$ ($TE_{11}$) mode.

9. The microwave transition of claim 1 wherein said dielectric rod has a circular transverse cross section and is dimensioned to propagate microwave signals in the $HE_{11}$ mode.

10. The microwave transition of claim 9 wherein said second dielectric material has a circular transverse cross section.

11. The microwave transition of claim 9 wherein said second dielectric waveguide has an elliptical transverse cross section.

12. The microwave transition of claim 9 wherein said second dielectric waveguide has an oval transverse cross section.

13. The microwave transition of claim 9 wherein said second dielectric waveguide has a rectangular transverse cross section.

14. The microwave transition of claim 1 wherein said second dielectric material is made of isotactic polypropylene.

15. The microwave transition of claim 1 wherein said second dielectric material tapers inwardly toward the distal end thereof to increase the gain of the transition.

16. The microwave transition of claim 15 wherein the second dielectric material tapers inwardly at an angle sufficiently small to prevent lateral radiation from the second dielectric material.

17. The microwave transition of claim 1 wherein said second dielectric material tapers outwardly toward the distal end thereof to increase the gain of the transition.

18. The microwave transition of claim 17 wherein the second dielectric material tapers outwardly at an angle sufficiently small to prevent lateral radiation from the second dielectric material.

19. The microwave transition of claim 1 wherein the end portion of the dielectric rod tapers inwardly at an angle of less than about five degrees within said dielectric transition region.

20. The microwave transition of claim 1 wherein said dielectric rod has an elliptical transverse cross section and is dimensioned to propagate microwave signals in the $HE_{11}$ mode.

21. The microwave transition of claim 20 wherein said second dielectric waveguide has an elliptical transverse cross section.

22. The microwave transition of claim 1 wherein said dielectric rod has an oval transverse cross section and is dimensioned to propagate microwave signals in the $HE_{11}$ mode.

23. The microwave transition of claim 22 wherein said second dielectric waveguide has an elliptical transverse cross section.

24. The microwave transition of claim 1 wherein said dielectric rod has a rectangular transverse cross section and is dimensioned to propagate microwave signals in the $HE_{11}$ mode.

25. The microwave transition of claim 24 wherein said second dielectric waveguide has a rectangular transverse cross section.

26. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal portion of said dielectric rod extending beyond the distal end of said metal waveguide, a second dielectric material surrounding and extending beyond said dielectric rod beyond the distal end of said metal waveguide and having a dielectric constant $\epsilon_2$ lower than the dielectric constant of said first dielectric material, an end portion of said dielectric rod tapering inwardly toward the distal end thereof defining a dielectric transition region for launching signals propagating toward the distal end of said dielectric rod into said second dielectric material, said signals being single-moded throughout said dielectric transition region, said dielectric rod having a diameter $d_1$ at the beginning of said dielectric transition region and terminating within said second dielectric material defining an end of said dielectric transition region, said signals propagating beyond said dielectric rod and through said second dielectric material at the end of said dielectric transition region, said second dielectric material having a diameter $d_2$ at the end of said dielectric transition region, and a third dielectric material surrounding said second dielectric material and having a dielectric constant $\epsilon_3$ lower than the dielectric constant of said second dielectric material, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2-\epsilon_3)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

27. The microwave transition of claim 26, wherein said third dielectric material is a foam.

28. The microwave transition of claim 27 wherein the dielectric constant of said third dielectric material is smaller than the dielectric constant of said second dielectric material and greater than the dielectric constant of air.

29. The microwave transition of claim 26 wherein the second dielectric material tapers outwardly toward the distal end thereof to increase the gain of the antenna.

30. The microwave transition of claim 29 wherein the second dielectric material tapers outwardly at an angle sufficiently small to prevent lateral radiation from the second dielectric material.

31. The microwave transition of claim 26 wherein the second dielectric material extends beyond the distal end of the first dielectric material.

32. A microwave antenna comprising a single moded metal waveguide adapted to operate at a wavelength $\lambda_0$, said metal waveguide tapering inwardly to a cutoff dimension near the distal end thereof, said cutoff dimension selected to enable propagation of a fundamental waveguide mode while cutting off higher order modes, a first dielectric waveguide having a dielectric constant $\epsilon_1$ mounted coaxially within the distal end portion of said metal waveguide, a distal portion of said first dielectric waveguide extending beyond the distal end of said metal waveguide, and a second dielectric waveguide surrounding and extending beyond said first dielectric waveguide beyond the distal end of said metal waveguide and having a dielectric constant $\epsilon_2$ lower than the dielectric constant of said first dielectric waveguide, an end portion of said first dielectric waveguide tapering inwardly toward the axis thereof defining a dielectric transition region for launching signals propagating toward the distal end of said first dielectric waveguide into said second dielectric waveguide, said signals being single-moded throughout said dielectric transition region, said first dielectric waveguide having a diameter $d_1$ at the beginning of said dielectric transition region and terminating within said second dielectric waveguide defining an end of said dielectric transition region, said signals propagating beyond said first dielectric waveguide and through said second dielectric waveguide at the end of said dielectric transition region, said second dielectric waveguide having a diameter $d_2$ at the end of said dielectric transition region, said first dielectric waveguide having a wavenumber $V_1$ defined by the equation $\pi d_1(\lambda_0)^{-1}(\epsilon_1-\epsilon_2)^{1/2}$, said second dielectric waveguide having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

33. The microwave antenna of claim 32 wherein the dielectric constant of said first dielectric waveguide is less than about 4.

34. The microwave antenna of claim 32 wherein said second dielectric waveguide extends beyond the distal end of said first dielectric waveguide.

35. The microwave antenna of claim 32 wherein said cutoff dimension of said metal waveguide containing said first dielectric waveguide is less than the cutoff dimension for the $TM_{01}$ mode.

36. The microwave antenna of claim 32 wherein the portion of said metal waveguide that is tapered inwardly is the portion that surrounds the outwardly tapered portion of said first dielectric waveguide.

37. The microwave antenna of claim 32 wherein the distal end of said metal waveguide is flared outwardly to launch signals from said metal waveguide into said first dielectric waveguide.

38. The microwave antenna of claim 32 wherein said metal waveguide is circular waveguide dimensioned to propagate microwave signals in the $H_{11}$ ($TE_{11}$) mode.

39. The microwave antenna of claim 22 wherein said dielectric rod has a circular transverse cross section and is dimensioned to propagate microwave signals in the $HE_1$ mode.

40. The microwave antenna of claim 39 wherein said second dielectric waveguide has a circular transverse cross section.

41. The microwave antenna of claim 39 wherein said second dielectric waveguide has an elliptical transverse cross section.

42. The microwave antenna of claim 39 wherein said second dielectric waveguide has an oval transverse cross section.

43. The microwave antenna of claim 39 wherein said second dielectric waveguide has a rectangular transverse cross section.

44. The microwave antenna of claim 32 wherein said second dielectric waveguide includes a foam dielectric.

45. The microwave antenna of claim 32 wherein said second dielectric waveguide tapers inwardly toward the distal end thereof to increase the gain of the antenna.

46. The microwave antenna of claim 32 wherein said second dielectric waveguide tapers outwardly toward the distal end thereof to increase the gain of the antenna.

47. The microwave antenna of claim 32 wherein the end portion of the first dielectric waveguide tapers inwardly at an angle of less than about five degrees within said dielectric transition region.

48. The microwave antenna of claim 32 wherein the second dielectric waveguide tapers inwardly toward the distal end thereof to increase the gain of the antenna.

49. The microwave antenna of claim 48 wherein the second dielectric waveguide tapers inwardly at an angle sufficiently small to prevent lateral radiation from the second dielectric waveguide.

50. The microwave antenna of claim 32 wherein the second dielectric waveguide tapers outwardly toward the distal end thereof to increase the gain of the antenna.

51. The microwave antenna of claim 50 wherein the second dielectric waveguide tapers outwardly at an angle sufficiently small to prevent lateral radiation from the second dielectric waveguide.

52. The microwave antenna of claim 32 wherein said dielectric rod has an elliptical transverse cross section and is dimensioned to propagate microwave signals in the $HE_{11}$ mode.

53. The microwave antenna of claim 52 wherein said second dielectric waveguide has an elliptical transverse cross section.

54. The microwave antenna of claim 32 wherein said dielectric rod has an oval transverse cross section and is dimensioned to propagate microwave signals in the $HE_{11}$ mode.

55. The microwave antenna of claim 54 wherein said second dielectric waveguide has an elliptical transverse cross section.

56. The microwave antenna of claim 32 wherein said dielectric rod has a rectangular transverse cross section and is dimensioned to propagate microwave signals in the $HE_{11}$ mode.

57. The microwave antenna of claim 56 wherein said second dielectric waveguide has a rectangular transverse cross section.

58. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal end portion of said dielectric rod extending beyond the distal end of said metal waveguide, and a second dielectric material surrounding said dielectric rod beyond the distal end of said metal waveguide and having a dielectric constant $\epsilon_2$ lower than the dielectric constant of said first dielectric material, an end portion of said dielectric rod tapering inwardly toward the distal end thereof defining a dielectric transition region for launching signals propagating toward the distal end of said dielectric rod into said second dielectric material. said dielectric rod having a diameter $d_1$ at the beginning of said dielectric transition region, said second dielectric material having a substantially constant diameter throughout said dielectric transition region, said second dielectric material having a diameter $d_2$ at the end of said dielectric transition region, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2=1)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

59. A microwave antenna comprising a single moded metal waveguide adapted to operate at a wavelength $\lambda_0$, said metal waveguide tapering inwardly to a cutoff dimension near the distal end thereof, said cutoff dimension selected to enable propagation of a fundamental waveguide mode while cutting off higher order modes, a first dielectric waveguide having a dielectric constant $\epsilon_1$ mounted coaxially within the distal end portion of said metal waveguide, a distal portion of said first dielectric waveguide extending beyond the distal end of said metal waveguide, and a second dielectric waveguide surrounding said first dielectric waveguide beyond the distal end of said metal waveguide and having a dielectric constant $\epsilon_2$ lower than the dielectric constant of said first dielectric waveguide, an end portion of said first dielectric waveguide tapering inwardly toward the axis thereof defining a dielectric transition region for launching signals propagating toward the distal end of said first dielectric waveguide into said second dielectric waveguide, said first dielectric waveguide having a diameter $d_1$ at the beginning of said dielectric transition region, said second dielectric waveguide having a substantially constant diameter throughout said dielectric transition region, said second dielectric waveguide having a diameter $d_2$ at the end of said dielectric transition region, said first dielectric waveguide having a wavenumber $V_1$ defined by the equation $\pi d_1(\lambda_0)^{-1}(\epsilon_1-\epsilon_2)^{1/2}$, said second dielectric waveguide having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

60. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal end portion of said dielectric rod extending beyond the distal end of said metal waveguide, and a second dielectric material surrounding said dielectric rod beyond the distal end of said metal waveguide and having a dielectric constant $\epsilon_2$ lower than the dielectric constant of said first dielectric material, an end portion of said dielectric rod tapering inwardly toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a diameter $d_2$ at the end of said dielectric transition region, said first dielectric material having a wavenumber $V_2$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, the upper limit of the wavenumbers $V_1$ and $V_2$ being about 2.4, said lower limit defining a point at which pattern degradation occurs due to fields extending too far outside of said first and second dielectric materials.

61. (new) The microwave transition of claim 60 wherein the lower limit of the wavenumber $V_1$ is about 1.5 and the lower limit of the wavenumber $V_2$ is about 1.0.

62. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal end portion of said dielectric rod extending beyond the distal end of said metal waveguide, and a second dielectric material surrounding said dielectric rod beyond the distal end of said metal waveguide and having a dielectric constant $\epsilon_2$ lower than the dielectric constant of said first dielectric material, an end portion of said dielectric rod tapering inwardly toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a diameter $d_2$ at the end of said dielectric transition region, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials, the lower limit of the wavenumber $V_1$ being about 1.5 and the lower limit of the wavenumber $V_2$ being about 1.0.

63. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal portion of said dielectric rod extending beyond the distal end of said metal waveguide, a second dielectric material surrounding said dielectric rod beyond the distal end of said metal waveguide and having a dielectric constant $\epsilon_2$ lower than the dielectric constant of said first dielectric material, an end portion of the dielectric rod tapering inwardly at an angle of less than about five degrees toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a diameter $d_2$ at the end of said dielectric transition region, and a third dielectric material surrounding said second dielectric material and having a dielectric constant $\epsilon_3$ lower than the dielectric constant of said second dielectric material, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2-\epsilon_3)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

64. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal portion of said dielectric rod extending beyond the distal end of said metal waveguide, a second dielectric material surrounding said dielectric rod beyond the distal end of said metal waveguide and having a dielectric constant $\epsilon_2$ lower than the dielectric constant of said first dielectric material, an end portion of the dielectric rod tapering inwardly toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a constant diameter throughout said dielectric transition region, said second dielectric material having a diameter $d_2$ at the end of said dielectric transition region; and a third dielectric material surrounding said second dielectric material and having a dielectric constant $\epsilon_3$ lower than the dielectric constant of said second dielectric material, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2-\epsilon_3)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

65. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal portion of said dielectric rod extending beyond the distal end of said metal waveguide, a second dielectric material surrounding said dielectric rod beyond the distal end of said metal waveguide and having a dielectric constant $\epsilon_2$ lower than the dielectric constant of said first dielectric material, an end portion of the dielectric rod tapering inwardly toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a diameter $d_2$ at the end of said dielectric transition region, and a third dielectric material surrounding said second dielectric material and having a dielectric constant $\epsilon_3$ lower than the dielectric constant of said second dielectric material, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_2(\lambda_0)^{-1}(\epsilon_2-\epsilon_3)^{1/2}$, said wavenumbers $V_1$ and $V_2$ having values between an upper limit and a lower limit, said upper limit defining a point at which the first and second dielectric materials are capable of supporting other than fundamental waveguide modes, the upper limit of the wavenumbers $V_1$ and $V_2$ being about 2.4, said lower limit defining a point at which pattern degradation occurs due to fields extending too far outside of said first and second dielectric materials.

66. The microwave transition of claim 65 wherein the lower limit of the wavenumber $V_1$ is about 1.5 and the lower limit of the wavenumber $V_2$ is about 1.0.

67. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal portion of said dielectric rod extending beyond the distal end of said metal waveguide, a second dielectric material surrounding said dielectric rod beyond the distal end of said metal waveguide and having a dielectric constant $\epsilon_2$ lower than the dielectric constant of said first dielectric material, an end portion of the dielectric rod tapering inwardly toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a diameter $d_2$ at the end of said dielectric transition region, and a third dielectric material surrounding said second dielectric material and having a dielectric constant $\epsilon_3$ lower than the dielectric constant of said second dielectric material, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_1(\lambda_0)^{-1}(\epsilon_2-\epsilon_3)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials, the lower limit of the wavenumber $V_1$ being about 1.5 and the lower limit of the wavenumber $V_2$ being about 1.0.

68. A microwave transition comprising a single-moded metal waveguide adapted to operate at a wavelength $\lambda_0$, a dielectric rod mounted coaxially within the distal end portion of said metal waveguide and made of a first dielectric material having a dielectric constant $\epsilon_1$, a distal portion of said dielectric rod extending beyond the distal end of said metal waveguide, a second dielectric material surrounding said dielectric rod beyond the distal end of said metal waveguide and having a dielectric constant $\epsilon_2$ lower than the dielectric constant of said first dielectric material, an end portion of the dielectric rod tapering inwardly toward the distal end thereof defining a dielectric transition region for launching signals propagating toward the distal end of said dielectric rod into said second dielectric material, said dielectric rod having a diameter $d_1$ at the beginning of said dielectric transition region, said second dielectric material having a diameter $d_2$ at the end of said dielectric transition region, the second dielectric material tapering inwardly toward the distal end thereof to increase the gain of the antenna, and a third dielectric material surrounding said second dielectric material and having a dielectric constant $\epsilon_3$ lower than the dielectric constant of said second dielectric material, said first dielectric material having a wavenumber $V_1$ defined by the equation $\pi d_1(\lambda_0)^{-1}(\epsilon_1-\epsilon_2)^{1/2}$, said second dielectric material having a wavenumber $V_2$ defined by the equation $\pi d_1(\lambda_0)^{-1}(\epsilon_2-\epsilon_3)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials.

69. The microwave transition of claim 68 wherein the second dielectric material tapers inwardly at an angle sufficiently small to prevent lateral radiation from the second dielectric material.

70. A microwave antenna comprising a single moded metal waveguide adapted to operate at a wavelength $\lambda_0$, said metal waveguide tapering inwardly to a cutoff dimension near the distal end thereof, said cutoff dimension selected to enable propagation of a fundamental waveguide mode while cutting off higher order modes, a first dielectric waveguide having a dielectric constant $\epsilon_1$ mounted coaxially within the distal end portion of said metal waveguide, a distal portion of said first dielectric waveguide extending beyond the distal end of said metal waveguide, and a second dielectric waveguide surrounding said first dielectric waveguide beyond the distal end of said metal waveguide and having a dielectric constant $\epsilon_2$ lower than the dielectric constant of said first dielectric waveguide, an end portion of said first dielectric waveguide tapering inwardly toward the axis thereof defining a dielectric transition region for launching signals propagating toward the distal end of said first dielectric waveguide into said second dielectric waveguide, said first dielectric waveguide having a diameter $d_1$ at the beginning of said dielectric transition region, said second dielectric waveguide having a diameter $d_2$ at the end of said dielectric transition region, said first dielectric waveguide having a wavenumber $V_1$ defined by the equation $\pi d_1(\lambda_0)^{-1}(\epsilon_1-\epsilon_2)^{1/2}$, said second dielectric waveguide having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, the upper limit of the wavenumbers $V_1$ and $V_2$ being about 2.4, said lower limit defining a point at which pattern degradation occurs due to fields extending too far outside of said first and second dielectric materials.

71. The microwave antenna of claim 70 wherein the lower limit of the wavenumber $V_1$ is about 1.5 and the lower limit of the wavenumber $V_2$ is about 1.0.

72. A microwave antenna comprising a single moded metal waveguide adapted to operate at a wavelength $\lambda_0$, said metal waveguide tapering inwardly to a cutoff dimension near the distal end thereof, said cutoff dimension selected to enable propagation of a fundamental waveguide mode while cutting off higher order modes, a first dielectric waveguide having a dielectric constant $\epsilon_1$ mounted coaxially within the distal end portion of said metal waveguide, a distal portion of said first dielectric waveguide extending beyond the distal end of said metal waveguide, and a second dielectric waveguide surrounding said first dielectric waveguide beyond the distal end of said metal waveguide and having a dielectric constant $\epsilon_2$ lower than the dielectric constant of said first dielectric waveguide, an end portion of said first dielectric waveguide tapering inwardly toward the axis thereof defining a dielectric transition region for launching signals propagating toward the distal end of said first dielectric waveguide into said second dielectric waveguide, said first dielectric waveguide having a diameter $d_1$ at the beginning of said dielectric transition region, said second dielectric waveguide having a diameter $d_2$ at the end of said dielectric transition region, said first dielectric waveguide having a wavenumber $V_1$ defined by the equation $\pi d_1(\lambda_0)^{-1}(\epsilon_1-\epsilon_2)^{1/2}$, said second dielectric waveguide having a wavenumber $V_2$ defined by the equation $\pi d_2(\lambda_0)^{-1}(\epsilon_2-1)^{1/2}$, said wavenumbers $V_1$ and $V_2$ having values between an upper limit and a lower limit, said upper limit defining a point at which the first and second dielectric materials are capable of supporting other than fundamental waveguide modes, said lower limit defining a point at which pattern degradation occurs due to fields extending too far outside of said first and second dielectric materials, the lower limit of the wavenumber $V_1$ being about 1.5 and the lower limit of the wavenumber $V_2$ being about 1.0.

* * * * *